US006063223A

United States Patent [19]

Klauke et al.

[11] Patent Number: 6,063,223

[45] Date of Patent: May 16, 2000

[54] DUAL CHAMBER FLEXIBLE TUBE DISPENSING PACKAGE AND METHOD OF MAKING

[75] Inventors: Christian W. Klauke; Igor F. Beaufils, both of Toledo, Ohio

[73] Assignee: Owens-Brockway Plastic Products Inc., Toleod, Ohio

[21] Appl. No.: 09/129,265

[22] Filed: Aug. 5, 1998

Related U.S. Application Data

[62] Division of application No. 08/707,564, Sep. 4, 1996, Pat. No. 5,823,391.

[51] Int. Cl.[7] ..... B29C 65/00

[52] U.S. Cl. ..... 156/242; 156/245

[58] Field of Search ..... 156/242, 245

[56] References Cited

U.S. PATENT DOCUMENTS

| | | | |
|---|---|---|---|
| D. 274,309 | 6/1984 | Aldrich . | |
| D. 348,829 | 7/1994 | Hallas . | |
| D. 356,026 | 3/1995 | Iaia et al. . | |
| 1,437,345 | 11/1922 | Marr | 222/142.9 |
| 1,568,160 | 1/1926 | Hibbert | 222/142.9 |
| 2,376,855 | 5/1945 | Hanley | 222/142.3 |
| 2,589,743 | 3/1952 | Snaith | 222/94 |
| 2,652,951 | 9/1953 | Esposito et al. | 222/42.1 |
| 2,661,871 | 12/1953 | Huenergardt | 222/129 |
| 2,764,309 | 9/1956 | Zelonka | 220/23.4 |
| 2,825,085 | 3/1958 | Ingraham | 401/19 |
| 2,890,816 | 6/1959 | Horland | 222/142.3 |
| 3,166,221 | 1/1965 | Nielsen | 222/137 |
| 3,335,915 | 8/1967 | Shannon | 222/142.9 |
| 3,347,420 | 10/1967 | Donoghue | 222/129 |
| 3,374,917 | 3/1968 | Troy | 220/23.4 |
| 3,506,157 | 4/1970 | Dukes . | |
| 3,581,940 | 6/1971 | Cella | 222/94 |
| 3,583,590 | 6/1971 | Ferraro | 215/10 |
| 3,613,955 | 10/1971 | Wetherell, Jr. | 222/83 |
| 3,673,302 | 6/1972 | Halsall et al. | 264/328.1 |
| 3,729,553 | 4/1973 | Gold et al. | 424/44 |
| 3,782,600 | 1/1974 | Columbus | 222/94 |
| 3,788,520 | 1/1974 | Dukess | 222/94 |
| 3,866,800 | 2/1975 | Schmitt . | |
| 3,876,112 | 4/1975 | Kramer | 222/132 |
| 3,955,715 | 5/1976 | Topor | 222/143 |
| 3,994,408 | 11/1976 | Belitzky | 215/10 |
| 4,065,536 | 12/1977 | Lucas | 264/535 |
| 4,165,812 | 8/1979 | Jennison | 215/10 |
| 4,381,841 | 5/1983 | Schwarz | 220/23.4 |
| 4,489,839 | 12/1984 | Epperson | 215/10 |
| 4,548,322 | 10/1985 | Cullen et al. | 206/526 |
| 4,548,606 | 10/1985 | Larkin | 604/414 |
| 4,573,595 | 3/1986 | Mednis | 215/10 |
| 4,592,478 | 6/1986 | Laconis | 220/23.83 |
| 4,632,268 | 12/1986 | Melzi et al. | 220/573 |
| 4,640,423 | 2/1987 | Mednis | 215/10 |
| 4,651,900 | 3/1987 | Horvath et al. | 222/144.5 |
| 4,656,840 | 4/1987 | Loofbourrow et al. | 62/530 |
| 4,666,068 | 5/1987 | Bush | 222/546 |
| 4,685,565 | 8/1987 | Sparling | 206/427 |
| 4,693,395 | 9/1987 | Tavss et al. . | |
| 4,974,756 | 12/1990 | Pearson et al. . | |
| 5,002,199 | 3/1991 | Frahm | 220/670 |
| 5,007,540 | 4/1991 | Beasley et al. | 206/581 |
| 5,038,963 | 8/1991 | Pettengill et al. | 222/145.3 |
| 5,050,755 | 9/1991 | Strawder | 220/23.4 |
| 5,052,590 | 10/1991 | Ratcliff | 222/94 |
| 5,065,875 | 11/1991 | Balavich | 215/10 |
| 5,083,679 | 1/1992 | Plough | 222/142.1 |
| 5,083,680 | 1/1992 | Plough | 222/142.1 |
| 5,101,997 | 4/1992 | Bagwell et al. | 222/23.4 |
| 5,114,044 | 5/1992 | Spanek, Jr. | 222/94 |
| 5,135,702 | 8/1992 | Eales | 264/516 |
| 5,137,178 | 8/1992 | Stokes et al. | 222/94 |
| 5,143,261 | 9/1992 | Drobish | 222/129 |
| 5,152,432 | 10/1992 | De Laforcade | 222/145.1 |
| 5,158,191 | 10/1992 | Douglas et al. | 215/10 |
| 5,158,209 | 10/1992 | Reil et al. | 222/129 |
| 5,167,349 | 12/1992 | Rodder et al. | 222/107 |
| 5,186,559 | 2/1993 | Fu | 401/44 |
| 5,213,235 | 5/1993 | Miranda | 222/107 |
| 5,223,245 | 6/1993 | Ibrahim et al. | 424/44 |
| 5,236,108 | 8/1993 | House | 222/541.9 |
| 5,244,120 | 9/1993 | O'Meara | 222/94 |
| 5,251,106 | 10/1993 | Hui | 361/744 |
| 5,259,505 | 11/1993 | Sobel | 206/509 |
| 5,269,441 | 12/1993 | O'Meara | 222/94 |
| 5,271,536 | 12/1993 | Wilson | 222/498 |
| 5,316,159 | 5/1994 | Douglas et al. | 215/10 |
| 5,316,398 | 5/1994 | Chandaria et al. | 401/18 |
| 5,318,203 | 6/1994 | Iaia et al. | 222/94 |

| | | | |
|---|---|---|---|
| 5,356,040 | 10/1994 | Reggiani | 222/129 |
| 5,381,916 | 1/1995 | Strawder | 220/23.4 |
| 5,386,918 | 2/1995 | Neveras et al. . | |
| 5,386,928 | 2/1995 | Blette | 222/94 |
| 5,392,947 | 2/1995 | Gentile | 220/665 |
| 5,702,033 | 12/1997 | Beaver . | |

FOREIGN PATENT DOCUMENTS

| | | |
|---|---|---|
| 3514134 | 10/1986 | Germany . |
| 3616207 | 11/1987 | Germany . |
| 54-24427 | 8/1979 | Japan . |
| 55-161623 | 12/1980 | Japan . |
| 55-48973 | 12/1980 | Japan . |
| 63-272670 | 11/1988 | Japan . |
| 3-162248 | 7/1991 | Japan . |
| 239665 | 9/1925 | United Kingdom . |
| 1103534 | 2/1968 | United Kingdom . |
| 9105731 | 5/1991 | WIPO . |

*Primary Examiner*—Francis J. Lorin

[57] ABSTRACT

A dual chamber flexible tube dispensing package is formed by providing a pair of plastic parisons, blow molding each parison to form a tube having a rigid finish, a shoulder adjacent the finish and a flexible body extending from the shoulder with a closed lower end; each tube having a generally D-shaped cross section throughout the finish, shoulder and body; each tube having an arcuate wall and a generally flat wall; and bringing the flat walls into abutting relationship. Each tube has a thread such that when the flat walls are in abutting relation, the thread on one tube form continuous thread with the thread of the other tube. In another form of dual chamber dispensing package, each tube has a plurality of vertically spaced integral ribs which extend transversely. The ribs on one tube are staggered relative to the ribs on the other tube so that when the tubes are brought into engagement, the ribs on one tube engage the ribs on the other tube and the shoulders are in abutment.

19 Claims, 7 Drawing Sheets

DUAL CHAMBER FLEXIBLE TUBE DISPENSING PACKAGE AND METHOD OF MAKING

This application is a division of application Ser. No. 08/707,564 filed Sep. 4, 1996 now U.S. Pat. No. 5,823,391.

This invention relates to dual chamber flexible tube dispensing packages wherein each of the tubes is adapted to be filled with a different viscous material and then simultaneously dispensed by simultaneously squeezing the tubes.

BACKGROUND AND SUMMARY OF THE INVENTION

It has heretofore been suggested that two flexible tubes can be brought together to form a dual flexible tube package, as shown for example, in U.S. Pat. No. 3,782,600, 4,687,663, 5,052,590, 5,244,120, 5,269,441, and 5,318,203.

In U.S. Pat. No. 5,318,203, there is disclosed the concept of utilizing elongated hollow flexible tubes, each of which has an upper end and lower end wherein the upper end is D-shaped and the lower end is round or oval shaped. The upper ends of the tubes are attached to a coupling which is joined to a dispensing base. The coupling has two exit orifices, one for each tube. The dispensing base includes two nozzles which are inserted into the two orifices.

Among the objectives of the present invention are to provide a dual flexible tube package which will effectively segregate active ingredients in the respective tubes; which is more readily manufactured; which is more readily filled; and which is more readily sealed.

In accordance with the invention the dual chamber flexible tube dispensing package comprises two substantially identical tubes that are mirror images of one another, except for the finishes. Each tube includes a rigid half finish, a rigid half shoulder and a flexible tubular body extending from the shoulder. The cross sections of the half finish, half shoulder and body of each tube are D-shaped such that each has a flat portion and all the flat portions are in a single plane. The two tubes have the flat portions in abutting relation to one another such that the dual tube package has a finish defined by the two half finishes, a shoulder defined by the two half shoulders and a dual chamber body defined by the two flexible tube bodies. The threads on the half finishes are located thereon such that when the two tubes are brought into abutting relation a continuous thread is formed on the finish. The resultant dual chamber flexible tube packages are then filled with the respective viscous materials and the open ends are sealed to complete the package. In another form of dual chamber dispensing package, each tube has a plurality of vertically spaced integral ribs which extend transversely. The ribs on one tube are staggered relative to the ribs on the other tube so that when the tubes are brought into engagement, the ribs on one tube engage the ribs on the other tube and the first portions of the shoulders are in abutment. Each rib is convex outwardly when viewed in transverse cross section.

The dual chamber flexible tube dispensing packages are formed by providing a pair of plastic parisons, blow molding each parison to form a container having a rigid half finish, a rigid half shoulder adjacent the finish and a flexible body extending from the shoulder to a rigid closed lower end. The rigid closed end of each container is cut-off to produce the two tubes. The flat portions of the two tubes are then brought into abutting relationship such that when the flat walls of the two tubes are in abutting relation, the thread on the half finish on one tube forms a continuous thread with the thread of the half finish on the other tube. This results in the dual chamber flexible tube dispensing package. The overall cross section of the resultant finish is cylindrical. The overall cross sectional configurations of the shoulder and flexible body are generally oval or round with the major axis at ninety degrees to the abutting flat portions.

DESCRIPTION OF THE PREFERRED EMBODIMENT

Figures 1, 2, 3, 4, 5:
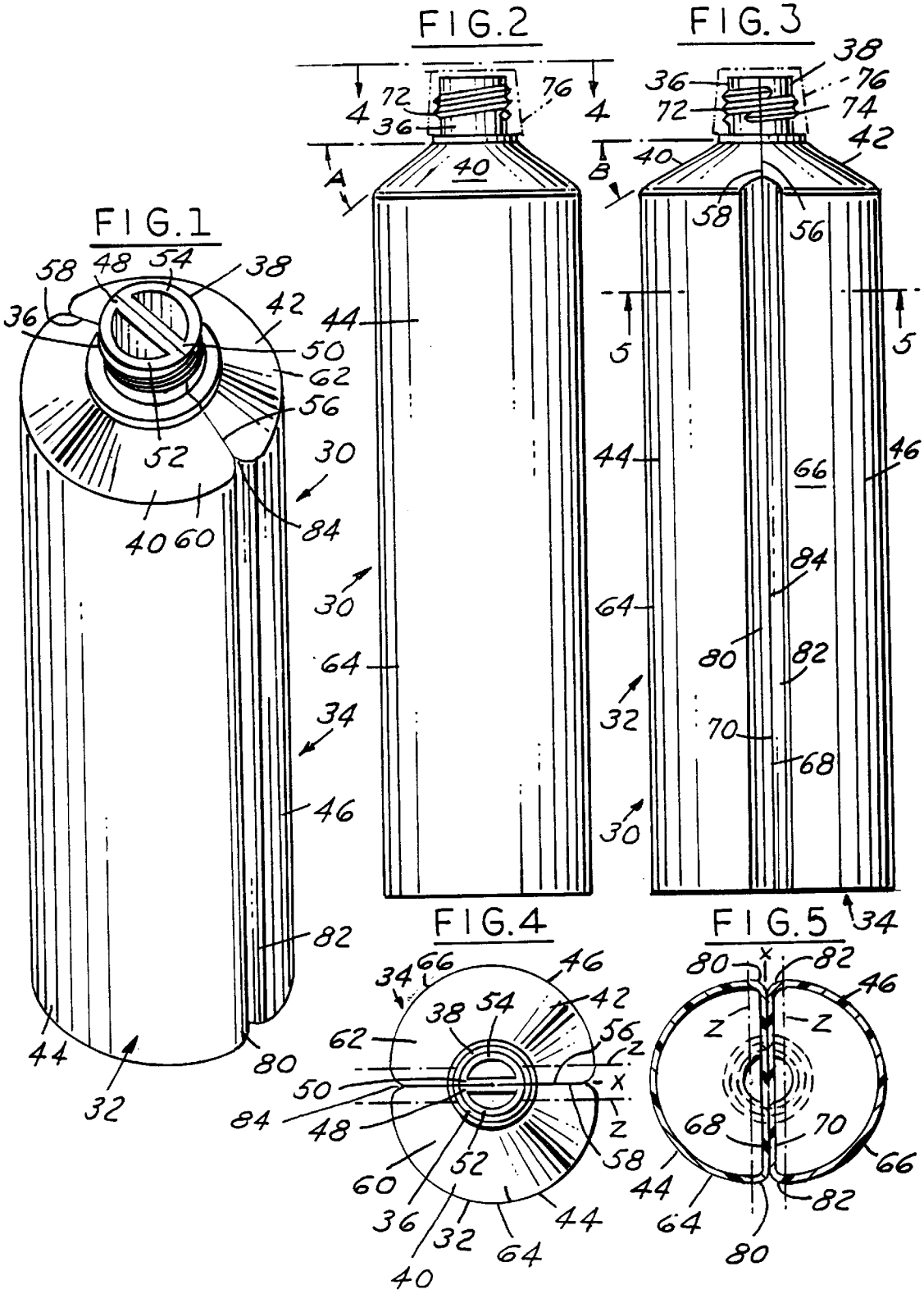
FIG. 1 is a perspective view of a dual chamber flexible tube dispensing package embodying the invention before being filled.
FIG. 2 is a front elevational view of the package shown in FIG. 1.
FIG. 3 is a side elevational view of the package shown in FIG. 1.
FIG. 4 is a top plan view taken along the line 4—4 in FIG. 1.
FIG. 5 is a bottom part sectional plan view taken along the line 5—5 in FIG. 3.
Figure 6:
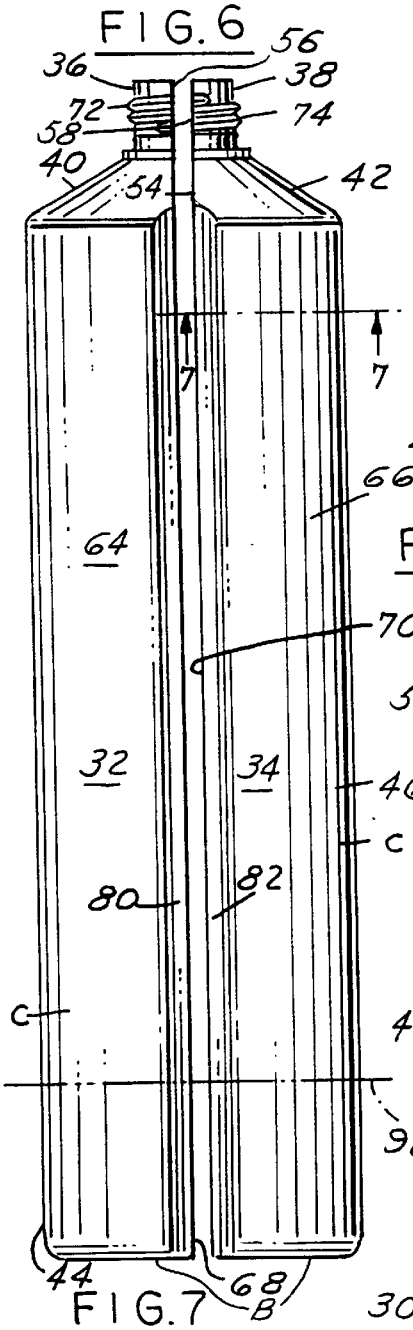
FIG. 6 is an elevational view of the package shown in FIG. 1 showing the two containers after being blow molded which are used to make the tubes.
Figure 8:
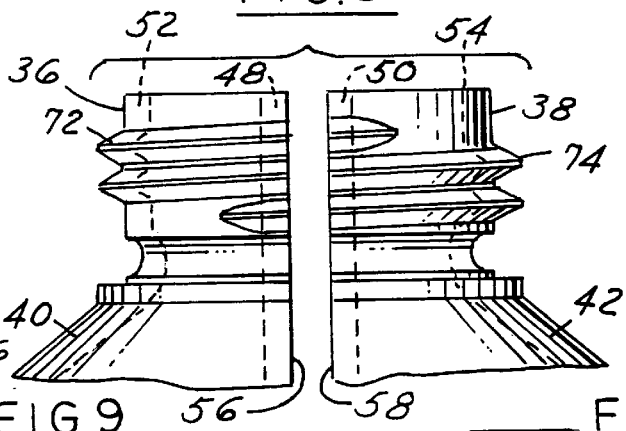
FIG. 8 is a fragmentary view on an enlarged scale of the upper end of two containers shown in FIG. 6.
Figure 9:
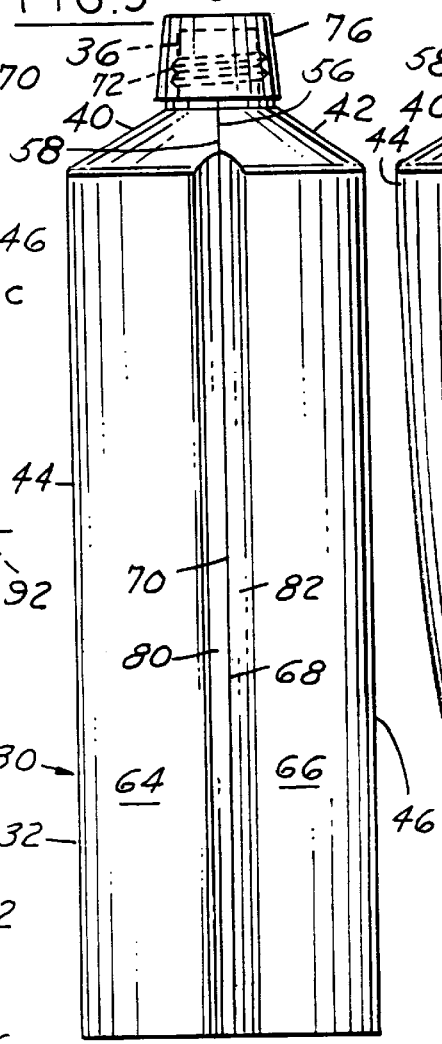
FIG. 9 is an elevational view similar to FIG. 3 showing the package being filled and the lower ends of the tubes sealed and including a closure on the package.
Figure 10:
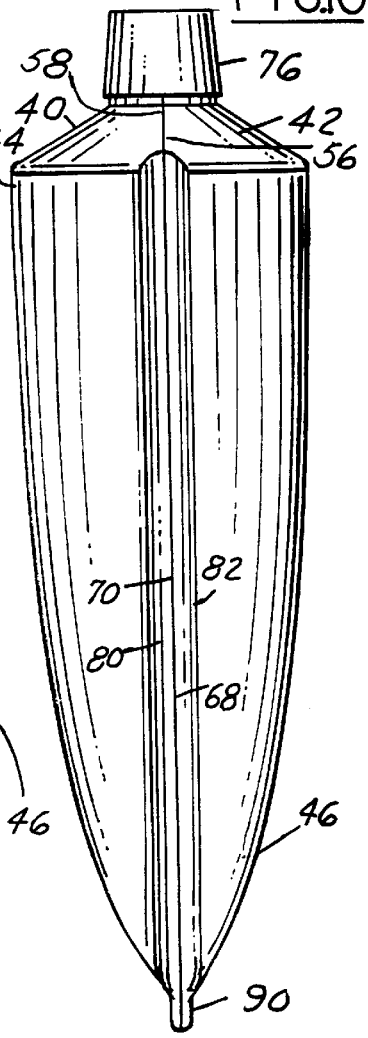
FIG. 10 is an elevational view similar to FIG. 9 showing the package after being filled and sealed.
Figure 7:
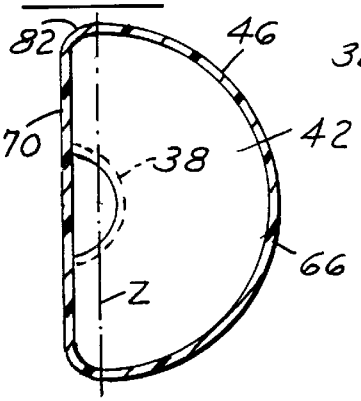
FIG. 7 is a sectional view taken along the line 7—7 in FIG. 6.

Referring to FIGS. 1–5, the dual chamber flexible tube dispensing package 30 embodying the invention comprises two plastic tubes 32, 34 which are in abutting relation to one another. Each tube 32, 34 is a mirror image of the other except for the threads, as presently described. Each tube 32, 34 includes a rigid half finish 36, 38, an integral rigid half shoulder 40, 42, and an integral thin flexible body 44, 46. The finish 36, 38, shoulder 40, 42 and body 44, 46 of each tube 32, 34 have flat surfaces abutting one another. As shown in FIG. 4, each half finish 36, 38 is generally D-shaped in cross section including a flat portion 48, 50 and an integral interconnecting wall extending from the ends of the flat wall portions 48, 50 to define an opening in each finish 36, 38 herein shown as an arcuate portion 52, 54. Each shoulder portion 40, 42 includes a flat portion 56, 58 and an arcuate portion 60, 62. Each tube body 44, 46 includes a arcuate wall portion 64, 66 and a flat wall portion 68, 70. As shown in FIGS. 1–3 and 5, the lower end of each body 32, 34 is open to provide for access for filling of the tubes 32, 34. Means are provided on the exterior of the half finish 36, 38 for interengaging a closure. As shown in FIGS. 2, 3 and 6, the means comprises a thread 72 on the half finish 36 and a thread 74 on the half finish 38 such that when the flat wall portions 48, 50 are in abutting relation a continuous thread is provided for the package which may receive a conventional threaded closure 76 (FIGS. 9, 10). Similarly, when the half finishes 36, 38 are in abutting relation, the flat portions 48, 50 form a double wall (FIG. 4). When the shoulder portions 40, 42 are in abutting relation, the flat portions 56, 58 define a double wall. The flat wall portions 68, 70 are in abutting relationship as shown in FIG. 5 to define a double wall.

As further shown in FIGS. 1, 3, 4 and 5, the flat wall portions 68, 70 of each tube body 44, 46 are joined to the curved portions 44, 46 by a curved portions 80, 82 along the edges of the flat portions 68, 70 such that an axial groove 84 is provided between each edge of the adjacent bodies 44, 46. As a result, the diametral width of the flat portions 68, 70 is less than the diametral width along the line X at the axial extremities of the arcuate wall portions 44, 46. The side walls of the grooves 84 are concave in radial cross section. The grooves 84 makes the package aesthetically more pleasing, and also facilitates handling, assembly and final sealing to close the open ends of the tubes. The overall cross section of the resultant finish is cylindrical. The overall cross sectional configurations of the shoulder and flexible body are generally oval or round with the major axis at ninety degrees to the abutting flat portions. The radius of the arcuate portions 44, 46 taken from the mold line X is constant.

In the preferred forms, the tubes 32, 34 are held in assembled relation by a closure 76. Alternatively, the two tubes 32, 34 can be bonded along the flat wall portions by a strip of adhesive, a plurality of adhesive areas or by sonic welding through the open ends along the flat wall portions.

After each tube 32, 34 is filled, the lower ends of the tubes are sealed by crimping and fusing by various commercially available methods (as at 90 in FIG. 10).

Each of the tubes 32, 34 is made from a plastic parison and blow molded in accordance with well known procedures to form a hollow container C (FIG. 6) which is then cut along a line 92 to provide the respective tube. The blow molding is done by any one well known blow molding methods such as extrusion blow molding, injection extrusion blow molding and injection molding a parison and blow molding the parison. In each instance, a parison is formed and blow molded. Preferred methods are extrusion blow molding and injection extrusion blow molding.

The containers and resultant tubes 32, 34 may be made of monolayer parisons or multilayer parisons depending on the viscous materials that are to be packaged. A satisfactory monolayer plastic parison is linear low density polyethylene. A satisfactory multilayer plastic extruded parison is one having an inner layer of low density polyethylene; an adhesive layer; a layer of ethylene vinyl alcohol; an adhesive layer; a layer of container regrind alone or including virgin low density polyethylene or polyethylene and colorant; and an outer layer of low density polyethylene alone or mixed with high density polyethylene and colorant.

In order to make the tubes of the present invention, the center line of each half finish is radially spaced from the parting line along the line Z (FIGS. 4, 5). In addition the cute angle formed on the outer surface of each shoulder 40, 42 changes circumferentially such that the angle A (FIG. 2) adjacent grooves 84 is greater than the angle B at ninety degrees to the grooves 84 or at the axial midpoint of arcuate wall portions 48, 50 (FIGS. 3 and 4).

Figure 11:
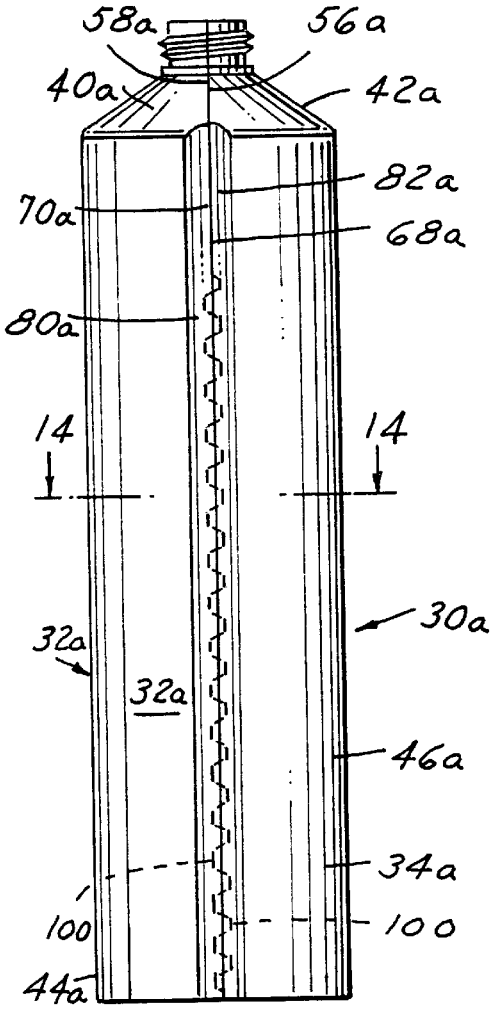
FIG. 11 is a side elevational view of a modified form of package before being filled.
Figure 12:
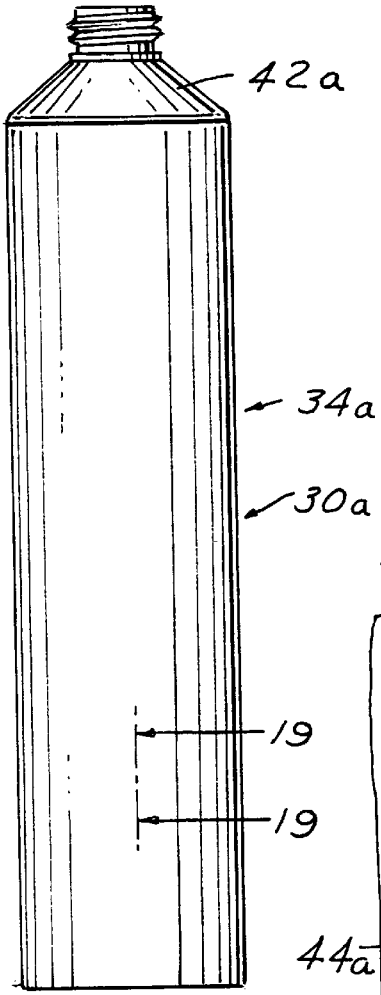
FIG. 12 is a front elevational view of the package shown in FIG. 10.
Figure 14:
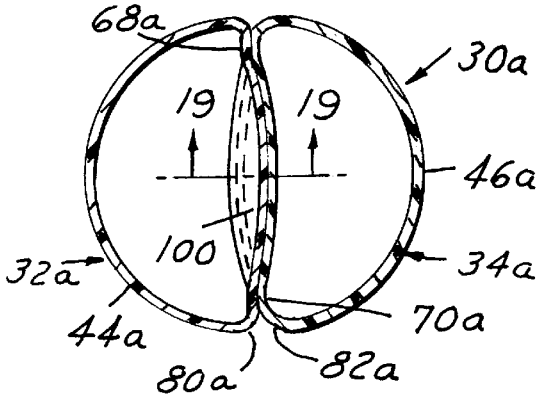
FIG. 14 is a sectional view taken along the line 1414 in FIG. 11.
Figure 16:
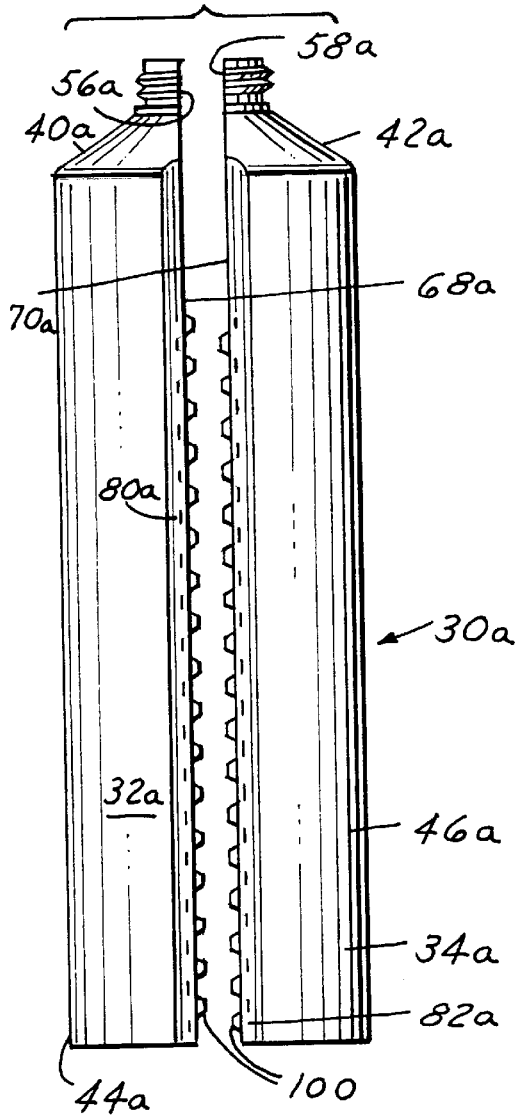
FIG. 16 is a side elevational view of the package shown in FIG. 11 showing two tubes side-by-side before assembly.
Figure 18:
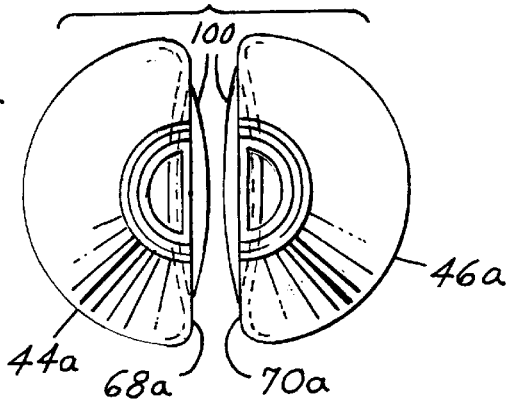
FIG. 18 is a top plan view of the package shown in FIG. 16.
Figure 17:
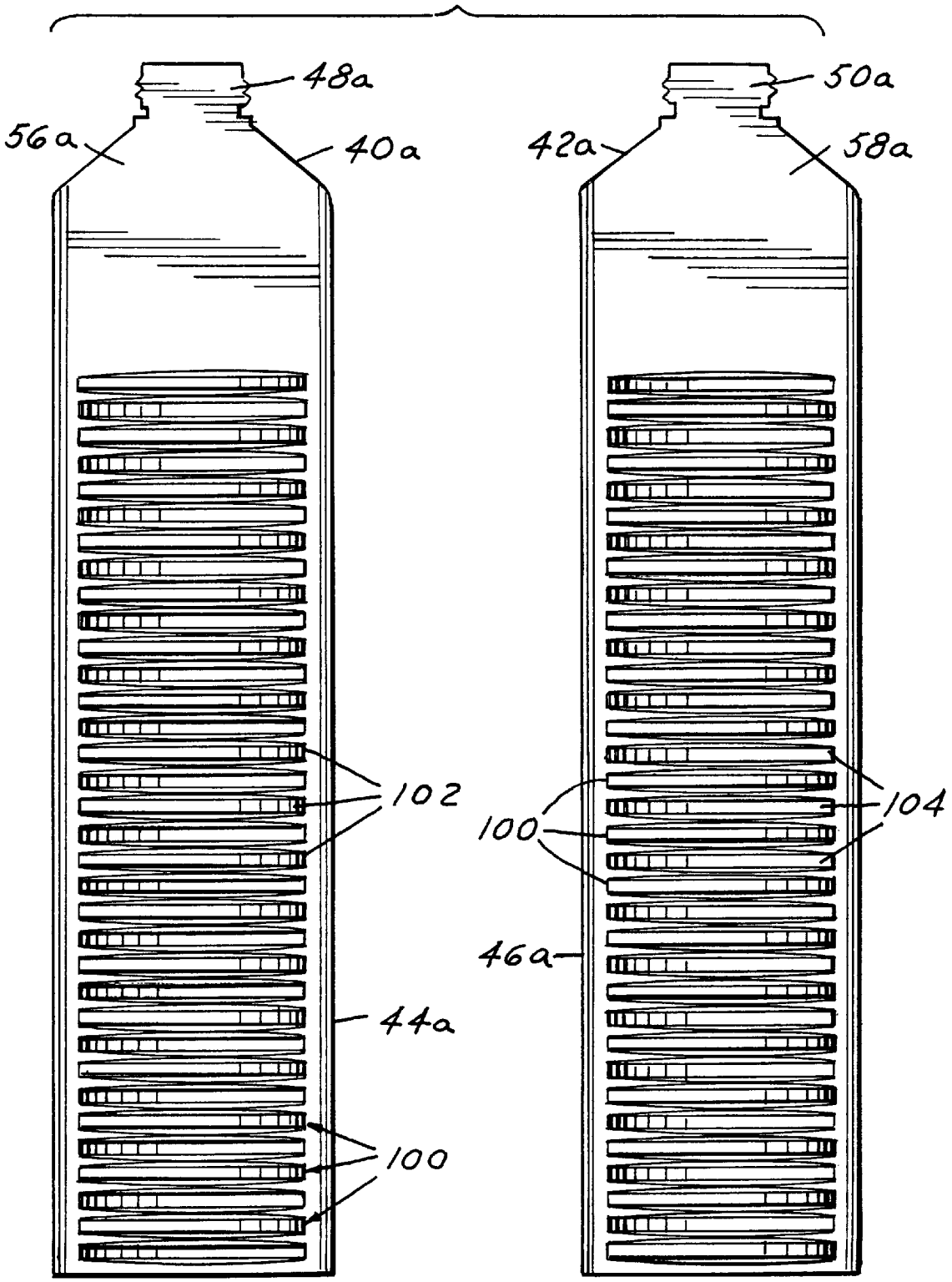
FIG. 17 is a side-by-side view of the two tubes.

In the modified form of package shown in FIG. 11–20, the two tubes 32*a*, 34*a* of the dual tube dispensing package are identical except for the flat wall portions (and the threads). For convenience, similar portions are identified with the suffix "a". The flat portions 68*a*, 70*a* of each tube body 44*a*, 46*a* are provided with a plurality of vertically spaced integral ribs 100 (FIGS. 16–20) which extend transversely. As shown in FIGS. 11 and 16, the ribs 100 on one tube are staggered relative to the ribs 100 on the other tube so that when the tubes are brought into engagement, the ribs 100 on one tube engage the ribs 100 on the other tube and the flat portions 56*a*, 58*a* of the shoulder 40*a*, 42*a* are in abutment (FIG. 11). Each rib 100 is convex outwardly when viewed in transverse cross section as shown in FIGS. 14 and 18.

Figure 19:
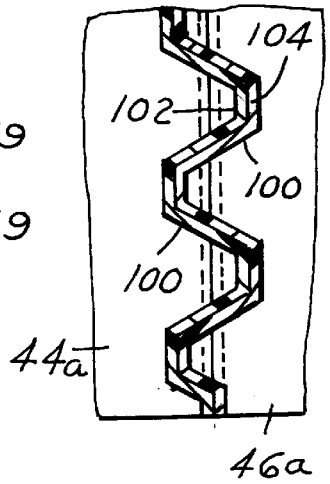
FIG. 19 is a fragmentary sectional view taken along the line 19—19 in FIG. 12.
Figure 13:
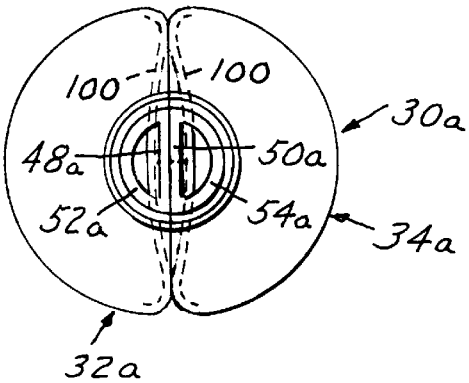
FIG. 13 is a top plan view of the package shown in FIG. 11.
Figure 20:
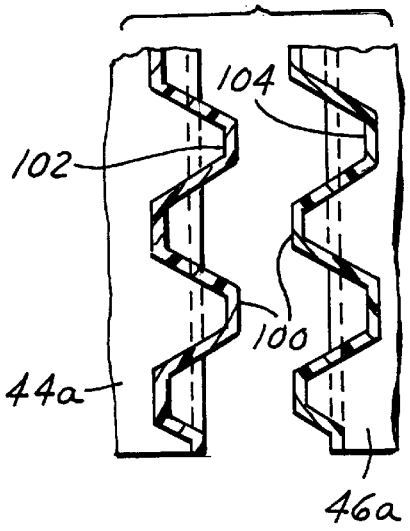
FIG. 20 is a fragmentary sectional view similar to FIG. 19 showing portions of the tubes before assembly.
Figure 15:
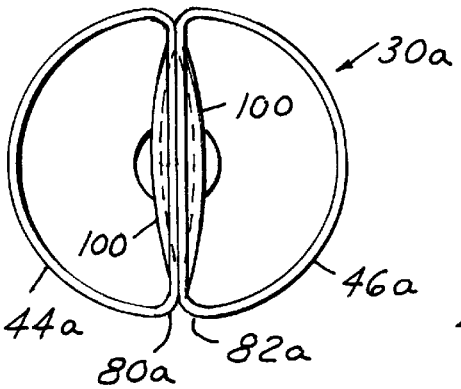
FIG. 15 is a bottom plan view of the package shown in FIG. 11.

Preferably, adhesive is applied on one or more of the flat portions of the tubes, for example, along the flat portion of the shoulder portions 40*a*, 42*a*. In addition, the apex 102 of each rib 100 (FIG. 20) is flattened for engagement with an intervening groove 104 of the other tube (FIGS. 19, 20).

Among the advantages of this form of the invention are ease of assembly and better filling and sealing line characteristics and is effective in maintaining the cross sectional configuration of the package including the D-shape.

Figures 21, 22, 23:
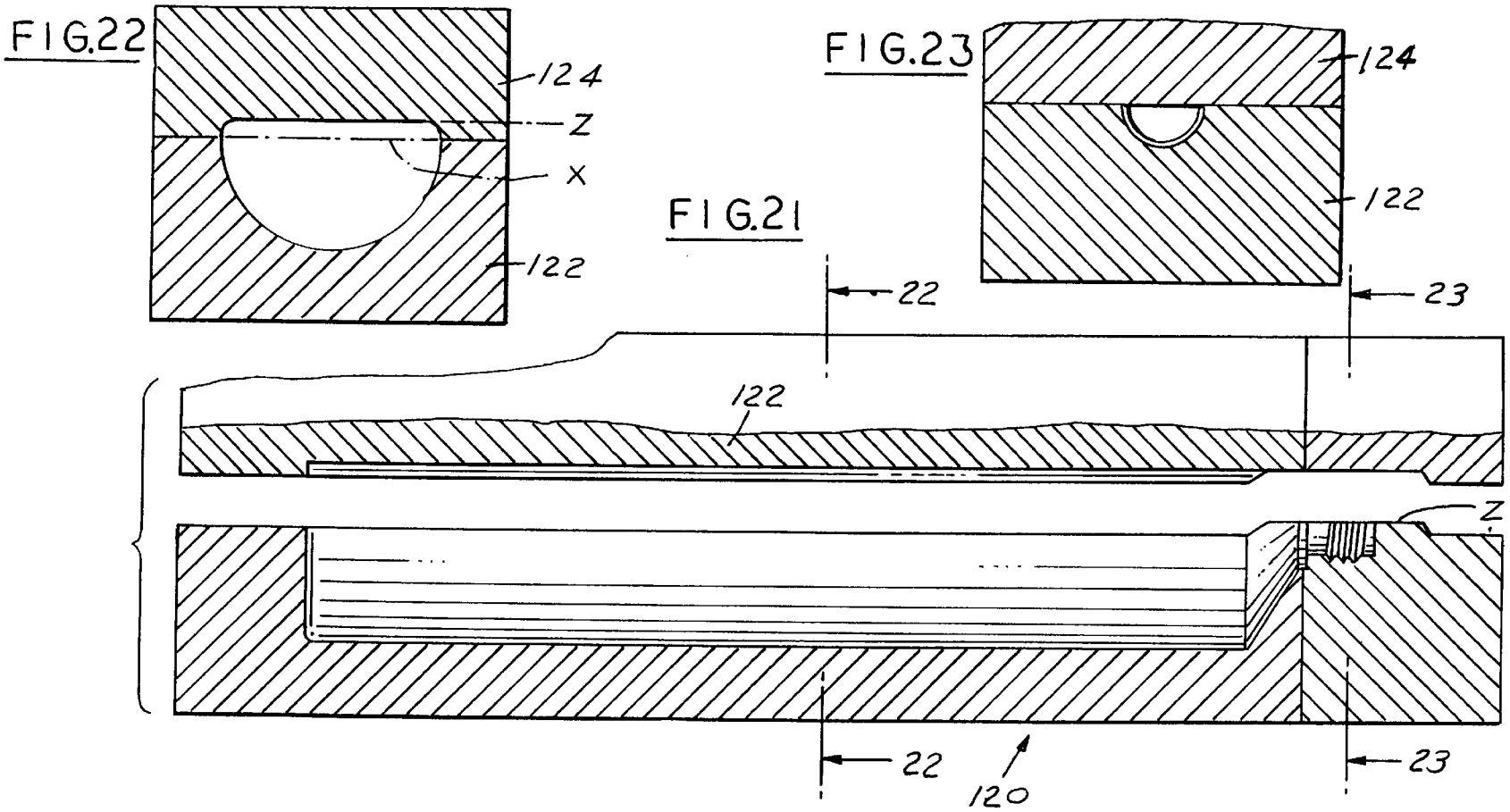
FIG. 21 is a part sectional partly schematic view of a mold utilized in making a container from which a tube for the package is made by blow molding.
FIG. 22 is a sectional view taken along the line 22—22 in FIG. 21.
FIG. 23 is a sectional view taken along the line 23—23 in FIG. 21.

FIGS. 21–23 are views of a mold for blow molding a parison to make one of the containers from which one of the tubes 32, 34 is made. The mold comprises mold halves 120, 122 which define the cavity. It can be seen that the mold line X defined by the two mold halves in the portion of the molds which define the body of the tube is displaced radially from the mold line or the center line Z of the half finish forming portion and shoulder forming portion of the mold half.

Further, it is desired to label or decorate the package and such labeling can be applied to the containers or the tubes before or after they are assembled to form the package. The labeling may be of well known methods including in-mold labeling of the containers, heat activated labels, pressure sensitive labels, shrink wrap labels on the package and offset labels.

Figure 24:
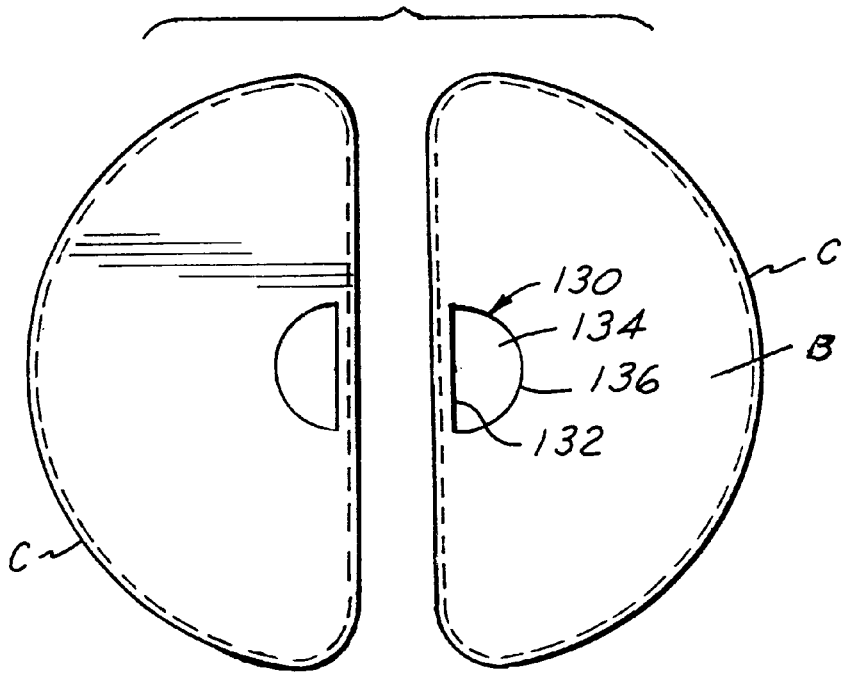
FIG. 24 is a bottom plan view of the side-by-side container shown in FIG. 6.
Figure 25:
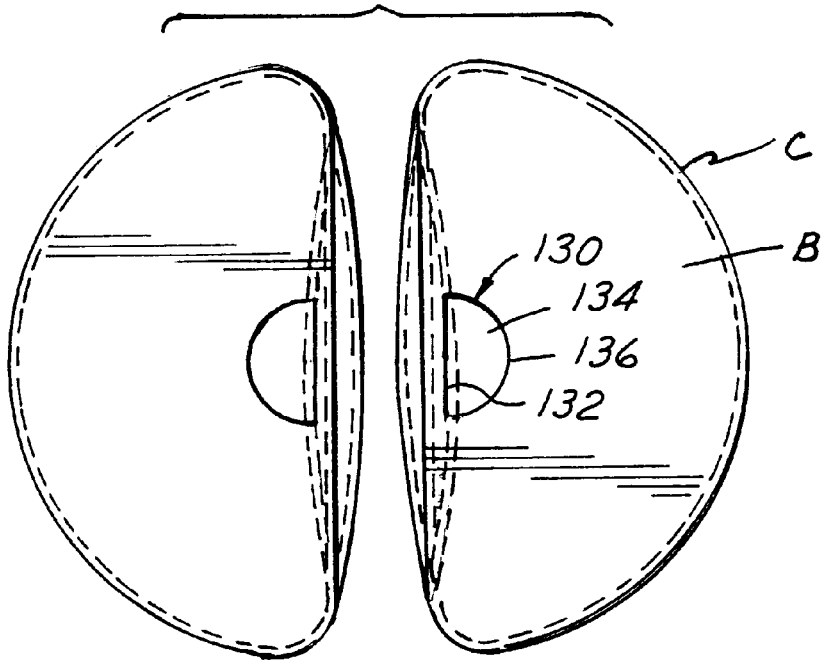
FIG. 25 is a bottom plan view of the side-by-side container shown in FIG. 16 before the bottom ends are cut off.

Referring to FIGS. 24 and 25, in each of the forms of the invention, each container C is formed with a depression recess 130 on the base wall B. Each recess 130 includes a diametral shoulder 132 parallel to the flat walls and an inwardly tapered surface 134 that extends from an apex 136 from the surface of the base to the shoulder 132 and is arcuate in cross section. The recesses 130 provide engaging surfaces for rotating each container as may be desired by engaging the finish of the container with a chuck and the base of the container with a chuck having a lug for engaging the recess 130. In addition, the recesses 130 may be similarly utilized for engagement of the two containers when they are brought together before severing.

Among the advantages of the dual chamber flexible tube dispensing package are the following;

1. Maintaining the contents of the two tubes isolated by a double wall until they are dispensed from the finish.
2. The ability to make one tube from a monolayer parison and the other tube of a multilayer parison where a multilayer and more costly parison is required for the contents of one of the tubes only.
3. The ability to have a different internal diameter opening on the half finish of one tube than the internal diameter opening of the other tube thereby controlling the amount of the contents of the respective tubes when the two tubes are squeezed.
4. The package is more readily manufactured and sealed.
5. The package can be manufactured and assembled at higher speeds and lower costs.

It can thus be seen that there has been provided a dual flexible tube package which will effectively segregate active ingredients in the respective tubes; which is more readily manufactured; which is more readily filled; and which is more readily sealed.

What is claimed is:

1. The method of forming a dual chamber dispensing package comprising forming a pair of plastic parisons, blow molding each said parison to form a tube having a rigid finish, a shoulder adjacent to the finish and a thin flexible body extending from said shoulder with a closed lower end, said shoulder and said body of each said flexible tube having a generally flat wall and an integral interconnecting wall extending from opposed edges of said flat wall, said flat wall having a plurality of axially spaced transversely extending integrally formed ribs, and bringing said flat walls into abutting relationship with the ribs on one tube nesting between adjacent ribs on the other tube.

2. The method set forth in claim 1 including forming means on said interconnecting wall of each said finish for engaging a closure.

3. The method set forth in claim 2 wherein said step of molding each said parison comprises forming each said finish, each said shoulder and each said body of each said flexible tube such that they are generally D-shaped in cross section.

4. The method set forth in claim 3 wherein said step of molding includes forming said interconnecting walls such that each said finish, each said shoulder and each said body is D-shaped in cross section.

5. The method set forth in claim 4 wherein said step of molding comprises forming the finish of each tube with thread means thereon such that, when the flat walls are in abutting relation, said thread means on one tube form continuous thread means with the thread means of the other said tube.

6. The method set forth in claim 5 including severing the closed lower end of each said tube opposite said finish such that it is open for filling.

7. The method set forth in claim 6 including forming recess means on the lower end of each tube to provide for handling and rotating said cube before severing.

8. The method set forth in claim 7 including filling said tubes through the open ends, and flexing and sealing the lower end of said tubes.

9. The method set forth in claim 1 including forming a curved wall portion joining said integral interconnecting wall and said flat wall of each said tube such that a groove is formed between the tubes when the tubes are brought into abutting relationship.

10. The method set forth in claim 1 wherein said step of forming said ribs comprises forming a flat apex on each said rib that abuts the wall between the ribs on the opposing tube when said tubes are brought into abutting relationship.

11. The method set forth in claim 10 wherein said ribs are formed such that they are convex outwardly in transverse cross section.

12. The method set forth in claim 1 wherein said step of blow molding comprises blow molding a single layer plastic parison.

13. The method set forth in claim 1 wherein said step of blow molding comprises blow molding a multiple layer plastic parison.

14. The method set forth in claim 1 wherein said step of blow molding comprises extrusion blow molding.

15. The method set forth in claim 1 wherein said step of blow molding comprises injection extrusion blow molding.

16. The method set forth in claim 1 wherein said step of blow molding comprises injection molding a parison and blow molding the parison.

17. The method set forth in claim 1 wherein said step of blow molding each tube comprises providing a blow mold that has two halves defining a cavity for forming the tube, said cavity including a finish forming portion, a shoulder forming portion and a body defining portion, said mold halves defining a mold line in the portion defining the body which is displaced radially from the mold line in the portions defining the shoulder and finish.

18. The method set forth in claim 17 including forming recess means on the lower end of each tube to provide for handling and rotating said tube before severing.

19. A method of forming a dual chamber dispensing package that comprises the steps of:

(a) molding a pair of separate plastic tubes each having a rigid finish, a rigid shoulder integrally extending from said finish, and a thin flexible body integrally extending from said shoulder, said finish, shoulder and body of each tube being molded in said step (a) such that each has a D-shaped cross section with a flat wall and said finishes having external thread portions, each said finish having a continuous wall with a flat portion forming said flat wall and a cylindrical portion on which said thread portion is disposed, said flat and cylindrical portions of the finishes having D-shaped openings into the associated tubes, (b) securing said separate tubes to each other with said flat walls in opposed abutting relation and said thread portions forming a continuous external thread on said finish, and (c) externally threading a closure over said finish to close said openings, wherein said step (a) includes providing a plurality of vertically spaced ribs on said flat walls of said tubes such that when the flat walls of said tubes are brought into abutting relation in said step (b), the ribs on one tube nest between the ribs on the other tube.

* * * * *